United States Patent [19]

Feffer

[11] 4,316,311

[45] Feb. 23, 1982

[54] BOUNCE CRIMPING APPARATUS

[75] Inventor: Philip C. Feffer, Silver Spring, Md.

[73] Assignee: Chevron Research, San Francisco, Calif.

[21] Appl. No.: 159,412

[22] Filed: Jun. 13, 1980

Related U.S. Application Data

[62] Division of Ser. No. 967,449, Dec. 7, 1978, Pat. No. 4,226,010.

[51] Int. Cl.[3] ..... D02G 1/16; D02G 1/12

[52] U.S. Cl. ..... 28/248; 28/254

[58] Field of Search ..... 28/220, 247, 248, 251, 28/254

[56] References Cited

U.S. PATENT DOCUMENTS

| | | | |
|---|---|---|---|
| 2,820,988 | 1/1958 | Wegener | 28/250 |
| 3,616,503 | 11/1971 | Mattingly | 28/251 |
| 3,879,819 | 4/1975 | Guenther | 28/251 |
| 3,938,226 | 2/1976 | Roberts | 28/251 |
| 4,081,886 | 4/1978 | Roberts | 28/251 |

FOREIGN PATENT DOCUMENTS

| | | | |
|---|---|---|---|
| 48-30022 | 9/1973 | Japan | 28/250 |

OTHER PUBLICATIONS

Stern, Hansjoerg, *Fluidics In Synthetic Fiber Quality Control,* Modern Textiles, LIII(11): pp. 10–14, Nov. 1972.

*Primary Examiner*—Robert Mackey

*Attorney, Agent, or Firm*—J. A. Buchanan, Jr.; T. G. DeJonghe; L. S. Squires

[57] ABSTRACT

An improved method and apparatus for bounce crimp texturizing thermoplastic yarn. The process and apparatus are characterized by a unique control system wherein either yarn thickness or a minute accumulation of the yarn discharged from the texturizer is sensed and the tension on the yarn controlled in response thereto so as to permit the yarn to issue from the texturizer in a loosely compacted tensionless state without significant intermediate yarn accumulation or piling prior to being continuously wound into packages.

By eliminating substantial intermediate accumulation or piling of the yarn, the process and apparatus substantially reduce tangles, thereby reducing breakage and random crimpless lengths produced by the pulling on the yarn caused by these tangles.

3 Claims, 3 Drawing Figures

BOUNCE CRIMPING APPARATUS

This is a division of application Ser. No. 967,449 filed Dec. 7, 1978, now U.S. Pat. No. 4,226,010, granted Oct. 7, 1980.

BACKGROUND OF THE INVENTION

1. Field of the Invention

This invention relates to an improved method and apparatus for fluidized texturizing yarn. In a further aspect, the invention relates to a fluidized bounce crimp texturizing method, and apparatus therefor, wherein the thickness or a minute accumulation of the yarn issuing from the fluidized bounce crimp texturizer (bounce crimper) is sensed and the rate at which the texturized yarn collected regulated to maintain the thickness or limit the accumulation of the texturized yarn within certain predetermined limits.

2. The Prior Art

Synthetic thermoplastic yarn materials are produced as a number of continuous, straight, smooth filaments. Such yarns have little bulk, and their utility in textile applications is thus rather limited.

In order to enhance the bulk and texture of synthetic yarns, a variety of crimping processes have been used in the past. One common technique which has been used for thermoplastic yarns is to bend the yarn filaments and heat the yarn while the filaments are in bent or crimped configurations.

One especially good texturizing technique, in terms of yielding a high-bulked yarn, is known as "rebound" or "bounce crimping".

Bounce crimping entails hurling yarn, propelled by a heated fluid through a jet, in a continuous stream-like flow against a foraminous surface upon which the yarn impinges and from which the yarn instantaneously rebounds or bounces. The impact of the yarn upon the foraminous surface axially buckles and crimps individual filaments of the yarn while the heated fluid passes through the foraminous surface. The texturized yarn progresses without tension and substantially by rebound inertia away from the crimping zone and, in the prior art process, is guided to a collection station where the yarn is heated and then cooled to heat-set the crimp prior to winding upon a storage spool.

Thermoplastic yarn texturized by the foregoing bounce crimping process possesses, inter alia, exceptional covering capability and a high degree of resiliency; note U.S. Pat. No. 3,686,848.

The basic process and apparatus for practicing the bounce crimp texturizing process is described by Clarkson in U.S. Pat. No. 3,665,567. Brielfy, the Clarkson process entails feeding a yarn through an elongate slender tube by a jet of steam and hurling the yarn longitudinally against a foraminous screen causing it to buckle in a random manner and bounce away in a random array. The yarn is thereby crimped or texturized and freely rebounds laterally through a passage from which it drops down to a receiver for heat-setting. The steam primarily passes through the foraminous screen and is collected.

In order to properly conduct bounce crimping, it is important that the yarn is rebounded from the screen and discharged from the bounce crimper under essentially no tension. The yarn cannot be pulled from the bounce crimper, since tension on the yarn at this point could pull the crimp from the yarn and could also cause the foraminous screen to be bypassed.

Various improvements in bounce crimp texturizing processes and apparatus are described in U.S. Pat. Nos. 3,859,696, 3,859,697, 3,879,819 and 3,887,971. All of the apparatus and processes described in these patents and in U.S. Pat. No. 3,665,567 are characterized by the use of a J-tube type yarn accumulator wherein the yarn is accumulated (piled) and heat-treated (heat-set and cooled). In U.S. Pat. No. 3,879,819, the J-tube is provided with a photocell light sensing means for maintaining a certain height (pile) of yarn in the J-tube by regulating the yarn wind-up speed in response to the sensing means.

The J-tube accumulator was used by the prior art to heat-set the crimp on the yarn and to ensure that the yarn rebounded from the bounce crimp screen in a tensionless state by permitting the yarn to free-fall into the accumulator from the bounce crimper. Subsequently, the J-tube was primarily used only for the second purpose.

In accumulating or piling the yarn, tangles were found to occur, resulting in localized pulling on the yarn as it was wound up, thus causing the crimp to be pulled out of random segments of the yarn and/or the yarn to break. The frequency of these breaks necessitated an increase in the number of operators required to operate or monitor a given number of texturizing machines and rethread the yarn when breaks occur.

Also, where low-denier yarns (e.g., about 500 denier or less) are used, the problem is magnified such that accumulator systems cannot be efficiently used. This magnification is believed caused by the fact that the lower the denier, the more loops or coils that are in contact with each other in the accumulator. Hence, the more contact, the more chance there is for filaments of the various loops to tangle with each other. This increased contact, coupled with the lower weight of the loops or coils, substantially increases the likelihood of the loops being pulled out of the accumulator, resulting in increased piling and tangles, etc.

SUMMARY OF THE INVENTION

The present invention provides a felicitous apparatus and method for collecting the yarn from the bounce crimp texturizer without tensioning the yarn in the critical area and without significantly accumulating (piling) the yarn. The present invention essentially eliminates the tangling problems of the prior art processes and apparatus and very substantially reduces yarn breaks and localized segments of straightened yarn and facilitates the use of high yarn speeds (e.g., 5200 feet per minute).

In summary, the process of the present invention comprises fluidized bounce crimping a thermoplastic yarn, using a heated fluid as the driving force, and sensing the thickness (diameter) of the yarn or the presence of a minute accumulation of yarn at a predetermined location downstream from the bounce crimper and controlling the windup speed of the yarn such that when the thickness or accumulation of the yarn exceeds a predetermined thickness or accumulation, the tension on the yarn downstream from the sensing device is increased by increasing the yarn windup speed thereby reducing the thickness or accumulation of the yarn. When the thickness or accumulation of the yarn is reduced to or below a second predetermined value (equal to or less than the first value), tension on the yarn is reduced to ensure that the yarn leaves the bounce crimper in a substantially tensionless state.

In summary, the yarn texturizing apparatus of the present invention comprises a fluidized bounce crimping means, a sensing means positioned downstream from said bounce crimper means for sensing the thickness of the yarn or for sensing a minute amount of yarn accumulation and control means operably connected to said sensing means for controlling the tension on said yarn downstream from said sensing means whereby when the thickness or accumulation of the yarn exceeds a predetermined value, said tension is increased by increasing the rate of yarn windup and when the thickness or accumulation of the yarn is equal or less than a second predetermined value (less than or equal to the first value) said tension is decreased.

BRIEF DESCRIPTION OF THE DRAWING

The drawings represent preferred non-limiting embodiments of the process and apparatus of the invention wherein.

FURTHER DESCRIPTION OF THE INVENTION AND PREFERRED EMBODIMENTS

Figure 1:
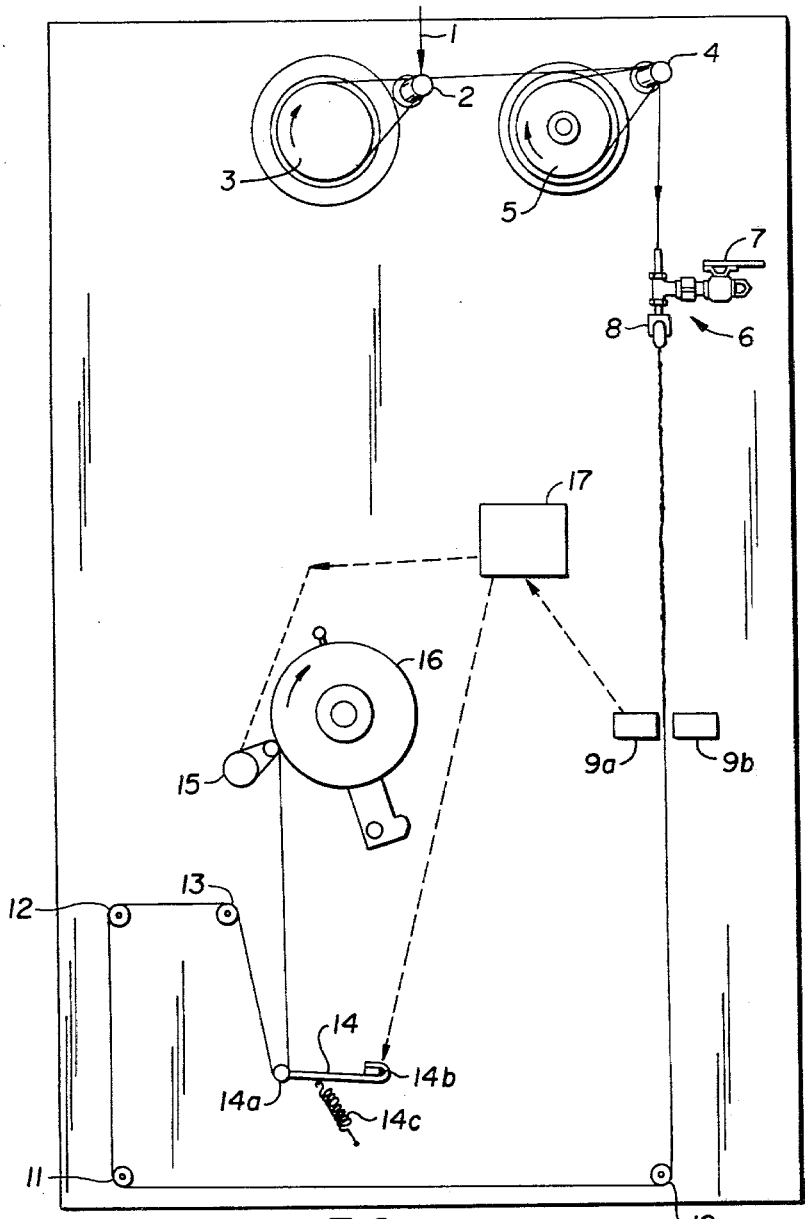
FIG. 1 is a schematic elevation representing the overall texturizing apparatus and process using a thickness-sensing mechanism.

According to the present invention, a drawn thermoplastic yarn is fed to a fluidized bounce crimper, such as, for example, described in the aforementioned patents, which disclosures are hereby incorporated by reference, wherein the yarn is bulked (crimped) by being propelled by a heated fluid (e.g., steam) against a foraminous surface (e.g., a screen). The yarn rebounds from the foraminous surface and is discharged from the texturizer via an outlet tube in an essentially tensionless state. The yarn thus in effect substantially free-falls from the outlet tube. The outlet tube can, for example, be curved, e.g., described in U.S. Pat. No. 3,887,971, or a horizontal straight outlet.

Due to the bounce crimping action and the compacting effect of the restricted crimper outlet tube, the yarn is crimped and leaves the outlet tube as a series of loops which are slightly entangled and compacted loop to loop. Because of this loop-to-loop entanglement and compaction, the yarn leaving the outlet tube has a gross diameter approaching the internal diameter of the bounce crimper outlet tube, e.g., 4 to 9 mm. It is desirable to remove (pull out) this loop-to-loop compaction entanglement, without removing yarn crimp and filament-to-filament entanglement, before the yarn is wound on the package. Also, as already explained, it is important that the yarn not be tensioned in the bounce crimper or outlet tube.

In accordance with the present invention, the diameter, or thickness, of the yarn or a minute amount of accumulation of yarn is sensed or measured at a point down-stream from the bounce crimper. The precise distance the sensing device is located from the bounce crimper is not critical, and is generally a function of the speed of response of the takeup winder. The sensing device setting or sensitivity, speed of response, and distance of the sensing device, is adjusted or correlated such that the yarn is not pulled from the bounce crimper and without causing more than a small accumulation of yarn. In a typical operation, the sensing device will usually be positioned about from 15 to 100 cm below the discharge end of the bounce crimper outlet tube.

The sensing device is set such that when the diameter, or thickness, or accumulation, of the yarn exceeds a predetermined value (typically a diameter of about from 1.25 to 2.5 mm or an accumulation height of about 1.5 to 10 mm, depending on the thickness of the yarn), the sensing means transmits a signal via a transmitting means to activate a controller means which in turn causes the tension on the yarn downstream from the sensing means to be increased by increasing the windup speed of the yarn. The increased tension on the yarn causes the loosely packed yarn to be pulled out, thereby reducing the thickness of the yarn without pulling out the crimp or filament-to-filament entanglement. The controller means can be considered as comprising a receiving means for receiving the signal from the transmitter and effecting the necessary change in yarn tension. In actual practice, the sensing, transmitting and controller means can be integrated into a single unit.

When the thickness or accumulation distance of the yarn has been reduced below a second predetermined value, the sensing device will relay this information to the controller, which will then reduce the tension on the yarn by reducing windup speed. The second predetermined yarn thickness or accumulation distance is selected to ensure that the yarn initially discharged from the bounce crimper will not be subjected to tension. Typically, a single thickness value or a single accumulation value and a single sensing means is used (i.e., the first and second predetermined values are the same). In this case, the yarn takeup speed will cycle between a higher takeup speed when the yarn thickness or yarn accumulation is equal to or exceeds the predetermined value and a lower speed when the yarn thickness or accumulation is respectively equal to or less than the predetermined value. The high speed is faster than the speed of the yarn leaving the crimper and the low speed is slower than the speed of the yarn leaving the crimper. How much higher and lower than the speed of the yarn leaving the crimper is a function of the response time of the takeup winder control system and motor. For example, if the entangled and crimped yarn (product) leaves the bounce crimper at 3500 ft/minute then, depending upon the response time of the winder system, a typical winder speed setting will be: high, 3600 ft/minute; low, 3466 ft/minute. In actual practice, the winder speed seldom reaches either the high or low speeds, because as soon as the diameter or accumulation is changed, the winder command is changed. Thus, winder command and winder speed typically continuously cycle between a speed approaching high and low speed settings. Optimization can be obtained by routine trial-and-error experimentation.

As should be apparent, because of the undesirability of accumulating, or piling, the yarn, the single-setting system is greatly preferred in the accumulation system and this setting preferably is set as low as possible such that the system is activated when a barely perceptible amount of yarn accumulation occurs.

The manner of operating the bounce crimp texturizer jet, itself, is unchanged by the present invention and is well known to the art. Suitable bounce crimp texturizing jets and their mode of operation are, for example, described in U.S. Pat. Nos. 3,859,696, 3,859,697, 3,879,819 and 3,887,971, which descriptions are hereby incorporated by reference. Also, as is conventional, the texturizer operation can be combined with an initial drawing operation wherein undrawn yarn is, for example, drawn by one or more pairs of (generally heated) drawing rolls. The second roll of each pair is operated at a higher peripheral speed than the first roll, thereby drawing the yarn. The details of such drawing also are well known to the art and can, for example, be had by reference to the immediately preceding U.S. patents already incorporated by reference. The drawn yarn is then fed to the texturizing jet.

Referring now to FIG. 1 of the drawings, a non-limiting embodiment of the invention will be described.

The overall apparatus typically comprises a panel board or frame upon which the various operative components of the apparatus, described hereinbelow, are mounted. Undrawn thermoplastic yarn 1 is fed from a supply package of yarn, not shown, to a first driven godet roller 3 with skewed separator roll 2 and then to a second driven godet roller 5 with skewed separator roll 4. Godet rolls 3 and 5 can be and typically are heated. Rolls 4 and 5 advance the yarn at a much greater speed than the rolls 2 and 3, thereby drawing yarn 1. For example, using nylon 66, rolls 4 and 5 are typically operated at a peripheral speed in the range of about from 3 to 3.6 times that of rolls 2 and 3, thereby effecting about a 3 to 3.6 draw in the yarn. Using nylon 66, godet rolls 3 and 5 are typically operated at temperatures in the range of about from 275° F. to 325° F. Using polypropylene, rolls 4 and 5 are typically operated at peripheral speeds in the range of about 2.7 to 3.1 times that of rolls 2 and 3, thereby effecting about a 2.7 to 3.1 draw in the polypropylene yarn. Using polypropylene, godet rolls 3 and 5 are typically operated at temperatures in the range of about from 222° F. to 275° F.

The yarn is typically fed to the bounce crimper at speeds in the range of about 3000 to 5000 fpm and leaves the crimper at speeds about 5 to 15% less than the feed speed due to the shortening of the yarn caused by crimping and loop compacting, previously discussed, and is ultimately wound up at over-all average speeds of about 5–10% less than the feed speed due to the retained crimping (but with substantial removal of the loop-to-loop compaction).

From roll 4, yarn 1 advances to bounce crimper 6. A fluid such as steam or heated air is fed to the bounce crimper through line 7. In the bounce crimper, a jet of fluid causes the yarn to be hurled against a screen (not shown) in the interior of the texturizing jet. From there, the yarn rebounds out through the outlet tube 8. The details of the fluid jet bounce crimper do not form part of the present invention, and exemplary details can be had by reference to U.S. patents already incorporated by reference, hereinabove, e.g., U.S. Pat. No. 3,665,567.

Yarn 1 leaves the bounce crimp texturizing jet in a substantially tensionless and loosely compacted state, and, as before noted, at this point has a diameter generally approaching or approximating the internal diameter of the outlet tube 8.

A sensing means (shown, as a light source means **9*a* and a light receiving means 9*b***, (e.g., photo-cell) are positioned in generally diametrically opposed relationship on or about opposite sides of the yarn to sense the thickness of the yarn.

Yarn 1 then passes over idler rollers 10, 11, 12 and 13 and compactor arm roller **14*a* to a windup package 16 driven by driving means 15. By adjusting compensator arm 14, as will be subsequently explained, or the speed of driving means 15**, the rate or speed of yarn takeup can be controlled.

Referring now to sensing means **9*a*–9*b*, this means is set such that when yarn equal to or greater than a first predetermined thickness passes between the light source 9*a* and light sensing means 9*b*, light from light source 9*a* is blocked from light sensing means 9*b*. Sensing means 9*b* then activates control means 17 which increases the tension on the yarn downstream from the sensing means by increasing the speed of yarn takeup by increasing the speed windup roll 16. For example, by directly increasing the speed of driving means 15, or by rotating a conventional compensator arm 14** counterclockwise.

Where the rate of takeup is varied by increasing the speed of the driving means 15, this can, for example, be effected by using D.C. motor and a speed control relay. Thus, the photocell senses the yarn (absence or presence of light) and in response thereto operates the speed control relay such that the motor rotates at a higher speed when light is not sensed and a lower speed when light is sensed. Where this method is used, the compensator arm control can be deactivated. The compensator arm means is a conventional method of controlling yarn takeup speed. As yarn tension increases, the compensator arm rotates about a pivot point **14*b* in a clockwise direction causing the rate of yarn takeup to decrease. Decreasing the yarn tension lets spring 14*c*** rotate the arm in a counterclockwise direction, causing the rate of yarn takeup to increase. Typically the nominal winder speed is set with the compensator arm in a horizontal position and speed is increased or decreased by the compensator arm relative to the nominal speed.

Because of the increased tension on the yarn, the loosely compacted yarn is decompacted until the thickness of the yarn is reduced such that light is no longer blocked from sensing means **9*b*. When this occurs, the sensing means (9*a*–9*b*) activates controller 17 to reduce the tension on the yarn either by reducing the speed of driving means 15 or the tension on compensator arm spring 14*c*, causing the compensator arm to rotate clockwise. Similarly, when the diameter of the yarn increases again to the first predetermined thickness, the controller will again be activated to increase yarn tension to reduce the diameter of the yarn to the second predetermined thickness, whereupon the controller will be activated to reduce yarn tension and so on. Hence, generally, as can be seen from the drawing, the yarn from the texturizing exit nozzle 8** to about the sensing means will be loosely (loop to loop) compacted, whereas below about the sensing means this loop-to-loop compaction will be substantially pulled out. This loose compaction is pulled out long before the tension is sufficient to pull out the crimp and thus no loss in crimp is caused by this control system. The yarn immediately rebounding from the bounce crimper screen and in the crimper outlet will be maintained essentially tensionless without any subsequent accumulation-piling of the yarn. Thus, the tangles caused by yarn piling and the ensuing breaks and crimp stretching, caused by the increased tension caused by this tangling, are eliminated.

Figure 2:
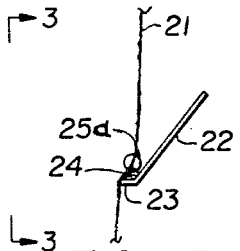
FIG. 2 is a representation of a yarn accumulation-sensing mechanism.
Figure 3:
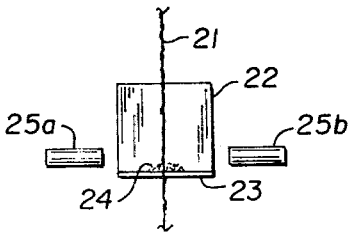
FIG. 3 is a side view of FIG. 2 along line 3—3.

Referring to FIGS. 2 and 3, FIG. 2 illustrates an accumulation distance-sensing device which could be used in place of the thickness sensing means **9*a*–9*b* shown in FIG. 1. Yarn 21 discharged from a bounce crimper, not shown, falls onto slanted plate 22, optionally having a substantially horizontal lip 23 wherein it accumulates into a small pile 24 and is continuously wound up on a windup means (not shown) such as shown in FIG. 1. Initially the yarn is wound up at a first speed relative to the discharge rate of the yarn from the bounce crimper such that the yarn accumulates in a small pile on plate 22. This accumulation continues until it blocks the passage of light beamed from a light source means 25***a* to a diametrically opposed light sensing means 25*b*. The light sensing means then activates a control means (not shown), causing the speed of the yarn windup to be increased until the height of yarn pile 24 falls below the height of the light-sensing means, thus activating the control means and returning the rate of yarn windup to the lower means. The height of the yarn sensing means is generally set such that a yarn pile or accumulation height or distance of 3 mm or less is sensed (depending upon the thickness of the yarn).

As before-noted, the present invention is applicable to thermoplastic yarns and deniers which can be bounce crimp texturized. Such thermoplastic yarns include, for example, nylon yarns, e.g. nylon 66, nylon 6, polyolefin yarns, e.g. polypropylene, combination yarns such as combinations of nylon and polypropylene; and the like. The drawn yarn fed to the bounce crimp texturizer typically has a denier in the range of about from 100 to 5000. Also, typically, the heated fluid used for the bounce crimper is steam or air.

Obviously, many modifications and variations of the invention, described hereinabove and below in the claims, can be made without departing from the essence and scope thereof.

I claim:

1. In an apparatus for bounce crimp texturizing of thermoplastic yarn comprising a fluidized bounce crimp texturizer having a yarn outlet nozzle for discharging texturized yarn, in a loosely compacted form therefrom; yarn supply means for supplying yarn to said texturizer and means for collecting yarn discharged from said bounce crimp texturizer; wherein the improvement comprises:

(a) disposing between said outlet nozzle and said collecting means and in operative relationship to said texturized yarn a sensing means for sensing and generating a first signal when the thickness of said yarn disposed relative to said sensing means exceeds a predetermined thickness and a second signal when the thickness of said yarn is equal to or less than a second predetermined thickness;

(b) a controller means comprising a receiver means for receiving said signals from said sensing means and a control means for controlling the rate of yarn takeup on said collecting means wherein when said receiver means receives said first signal, said control means causes the rate of yarn takeup to increase, thereby increasing downstream tension on said yarn and correspondingly decreasing the thickness of said yarn sensed by said sensing device and wherein when said receiver means receives said second signal it activates said control means to reduce the rate of said yarn takeup thereby reducing downstream yarn tension and correspondingly increasing said yarn thickness whereby said yarn is discharged from said compacting outlet in a loosely compacted tensionless state and is not accumulated prior to being collected by said collecting means, thereby substantially reducing tangles.

2. The apparatus of claim 1 wherein said sensing means comprises a means for sensing a single yarn thickness whereby said first signal is generated by said sensing means when a yarn thickness greater than a predetermined value is sensed and said second signal is generated when a yarn thickness equal to or less than said predetermined value is sensed.

3. The apparatus of claim 1 wherein said sensing means comprises a first light source means for providing a first beam of light and a first light receiving means positioned substantially diametrically opposed to said first light source for activating said controller means when said first beam of light is blocked from said first light receiving means and wherein said first light source means and said first light receiving means are positioned such that said texturized yarn passes between them.

* * * * *